United States Patent [19]

Eckels

[11] 4,447,670

[45] May 8, 1984

[54] HIGH-CURRENT CRYOGENIC LEADS

[75] Inventor: Phillip W. Eckels, Penn Hills, Pa.

[73] Assignee: Westinghouse Electric Corp., Pittsburgh, Pa.

[21] Appl. No.: 367,144

[22] Filed: Apr. 9, 1982

[51] Int. Cl.[3] ..... H01F 5/08

[52] U.S. Cl. ..... 174/15 CA; 138/40; 336/62

[58] Field of Search ..... 174/15 CA, 15 HP; 62/511, 514; 138/40, 113, 148; 336/62

[56] References Cited

U.S. PATENT DOCUMENTS

| | | | |
|---|---|---|---|
| 3,427,815 | 2/1969 | Pitlor | 62/514 R |
| 3,611,227 | 10/1971 | Trabut | 336/62 |
| 3,693,648 | 9/1972 | Sassin | 138/113 X |
| 3,835,239 | 9/1974 | Schmidt | 174/15 CA X |
| 3,849,589 | 11/1974 | Schmidt et al. | 174/15 CA X |
| 4,369,636 | 1/1983 | Porcell et al. | 62/514 R |

FOREIGN PATENT DOCUMENTS

| | | | |
|---|---|---|---|
| 901218 | 7/1962 | United Kingdom | 174/15 CA |

OTHER PUBLICATIONS

Hilal, M. A. et al, "A Method for Preventing Pressure Oscillations in Tubes Connecting Liquid Helium Reservoirs to Room Temperature", Cryogenics, vol. 16, No. 2, Feb. 1976, p. 122.

*Primary Examiner*—G. P. Tolin
*Assistant Examiner*—Morris H. Nimmo
*Attorney, Agent, or Firm*—William D. Lanyi

[57] ABSTRACT

A cryogenic lead is described which comprises a plurality of tubular conductors arranged in parallel association and connected to two conductive blocks. Each tubular conductor is a laminar assembly of an inner conductive sleeve and an outer sleeve which acts as a thermal mass to absorb heat from the inner sleeve during thermal perturbations. A fluid refrigerant is directed through the tubular conductors. Each tubular conductor has at least one flow restrictor disposed within its inner sleeve to reduce the relative effect of changes of refrigerant viscosity on pressure drop within the tubular conductor and to block the transmission of thermal radiation through the tubular conductor.

11 Claims, 3 Drawing Figures

HIGH-CURRENT CRYOGENIC LEADS

BACKGROUND AND SUMMARY OF THE INVENTION

The present invention relates to high-current cryogenic leads for pulsed power and high thermal inertia applications and, more particularly, cryogenic leads which are used in conjunction with supercooled coils to provide high thermal stability.

When electrical current flows between a current source which is at room temperature and a coil which is immersed in a pool of liquid refrigerant, such as helium, the electrical connections, or leads, between the source and the coil must be cooled to prevent overheating due to a high current flow therethrough. In order to provide sufficient cooling, cryogenic leads are typically provided with a plurality of channels through which a refrigerant can flow. One method for providing this refrigerant flow is to construct the cryogenic lead from a plurality of conductive tubes. This tubular arrangement is described in *MFTF Magnet Cryostability,* 8th Symposium on Engineering Problems of Fusion Research, 1979, IEEE Publication No. 79CH1441-5NPS pages 1761–1764 by J. H. VanSant. Each tube provides a parallel electrical path with its associated tubes and acts as a fluid conduit for refrigerant to flow through its central bore.

When a cryogenic lead is constructed from a plurality of tubes as described above, the current flowing through any individual tube must be generally equal to the current flowing through each of its associated tubes. Otherwise, if one tube conducts a significantly higher amount of current than the rest, it can potentially overheat and be damaged.

It should be understood that when a plurality of tubes are conducting both refrigerant flow and electric current in parallel, slight variations of temperature, rate of coolant flow, refrigerant viscosity and pressure drop along the length of the tube can exist between individual tubes in a particular cryogenic lead. These slight variations between the tubes of a cryogenic lead can cause the physical conditions of two or more distinct tubes to diverge and, therefore, cause the cryogenic lead to be thermally unstable.

Potential thermal instability is caused by the functional relationships which exist between refrigerant flow rate, tube temperature, refrigerant viscosity and pressure drop from one end of a tube to the other. For example, using a two-tube cryogenic lead as an example, one tube may experience a temporarily increased flow rate through it. This increased flow rate of a refrigerant would temporarily lower the temperature of that tube and the coolant relative to its other associated tube and coolant flowing therethrough. When the temperature of the refrigerant flowing through that tube is lowered, its viscosity is reduced. This lower viscosity causes the pressure drop along the length of that tube to be reduced which, in turn, causes a higher flow rate of the available refrigerant flowing through that cooler tube. This increased flow rate causes more efficient cooling, which further lowers the viscosity and pressure drop. This induces a reduced coolant flow in the associated tube. It should be apparent that these functional relationships, following a perturbation of refrigerant flow through a specific tube, cause the thermal conditions within the exemplary two-tube lead to become unstable resulting in one tube's temperature being significantly reduced in comparison to its initial condition and producing a temperature rise in the associated tube in which no perturbation occurred. It is the solution of this thermal instability problem to which the present invention is directed.

A cryogenic lead made in accordance with the present invention comprises a plurality of tubes connected both electrically and fluidly in parallel. Each individual tube is connected electrically to a conductive block at each of its ends. Each tube is a laminar composite of two coaxial and concentric tubular sleeves. The inner tubular sleeve is made of copper and the outer tubular sleeve is made of stainless steel. The inner copper sleeve provides good electrical conductivity and the outer stainless steel sleeve acts as a thermal mass into which heat can be transferred from the copper sleeve to prevent overheating damage to the inner conductive copper sleeve as might occur with a momentary loss of coolant flow. In order to prevent the thermal instability described above, each tube is provided with one or more fluid flow restrictions placed in its inner bore. Each of these restrictions has an orifice which restricts and reduces the flow of coolant gas through the tube. These orifices also reduce the amount of radiated heat that can be transmitted through the tube in the direction opposite that of the refrigerant flow. In order to further reduce this radiation, the orifices in the above-described restrictions can be arranged in such a way so that they are not aligned.

The present invention operates on the concept that if the functional relationship between changes in the viscosity and the pressure drop along the length of the tube can be reduced or essentially eliminated, the abovedescribed thermal instability can be prevented. The pressure drop along a conduit through which a fluid is flowing is a function of two independent factors. The first, which is related to the frictional effects of the conduit on the fluid flow, includes a direct relationship with the viscosity of the fluid and the length of the conduit and an inverse relationship with the velocity of the fluid and the square of the diameter of the conduit. The second, which is related to obstructions in the conduit which create turbulent flow, is a loss coefficient which is directly related to the pressure drop along the length of the tube and is a function of the dimensions and configuration of the obstruction causing the turbulent flow. In a tube with no obstructions, the first factor dominates and a reduction in the viscosity of the fluid produces a corresponding reduction in the pressure drop which cooperates to exacerbate the thermal instability as described above. The present invention utilizes one or more orifices placed within the bore of the conduit in order to increase the effect of the second factor, discussed above, on the pressure drop within the tube. If this second factor is made significant enough to dominate the effects on pressure drop, relative to the viscosity effects, the tube's tendency towards thermal instability can be reduced to insignificance.

The inclusion of a predetermined number of orifices, or fluid flow restrictors, within the conduit therefore can eliminate thermal instability in the cryogenic lead and also increase the lead's thermal efficiency by reducing the amount of heat radiated through the tubes in a direction opposite to that of the coolant flow. It should, therefore, be apparent that the present invention provides a cryogenic lead construction which prevents thermal instability while increasing the thermal efficiency of the lead's operation.

DESCRIPTION OF THE PREFERRED EMBODIMENT

Figure 1:
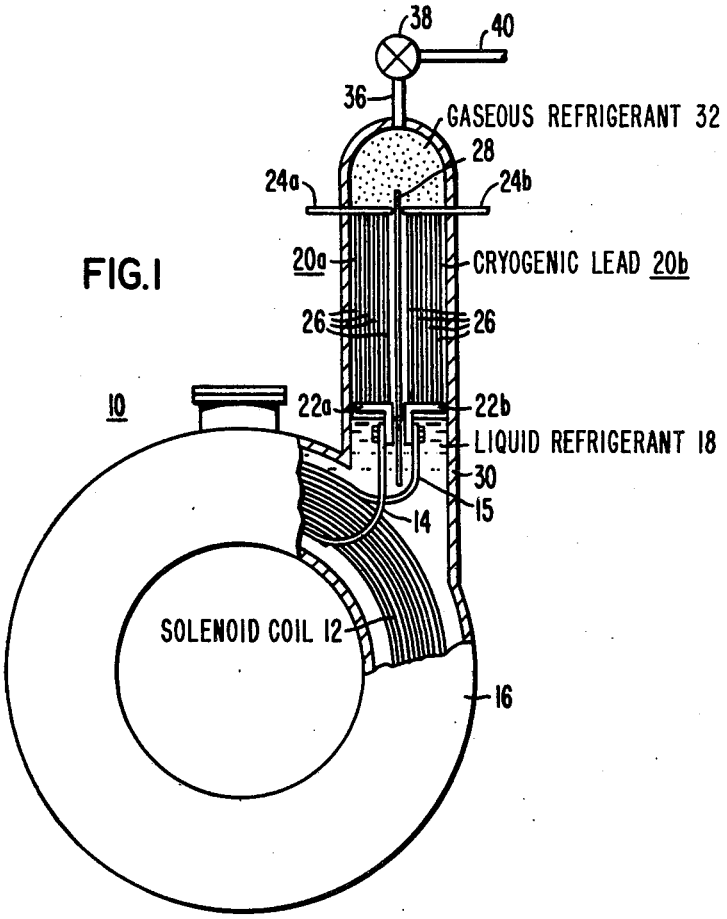
FIG. 1 shows a cryogenic solenoid coil that incorporates the cryogenic lead of the present invention.

FIG. 1 illustrates a typical cryogenically cooled solenoid coil 10 which includes a toroidally wound conductor 12 which has two termini, 14 and 15. The coil 12 is enclosed in an outer case 16 and submerged in a pool of liquid refrigerant 18, such as helium. The conductive material of the coil 12 is typically a niobium-titanium alloy. Each of the coils termini, 14 and 15, is electrically connected to a cryogenic lead, 20*a* and 20*b*, respectively. The two cryogenic leads, 20*a* and 20*b*, are essentially identical in construction. Each has a bottom conductor block, 22*a* and 22*b* respectively, and a top conductor block, 24*a* and 24*b*, respectively. Between these two conductive blocks, a plurality of tubes 26 are disposed in parallel association.

The two cryogenic leads, 20*a* and 20*b*, are separated by a non-conductive wall 28 and are enclosed in a containment 30 which encloses the leads, 20*a* and 20*b*, and the refrigerant in both its liquid 18 and gaseous 32 states. The containment 30 is in fluid communication with the case 16 of the solenoid coil and is provided with a conduit 36 and a pressure control valve 38 through which gaseous refrigerant 32 can be removed from the containment 30. The pressure of the gaseous refrigerant 32 can thus be regulated by control of the valve 38 which can release the gaseous refrigerant 32 through conduits 36 and 40.

Figure 2:
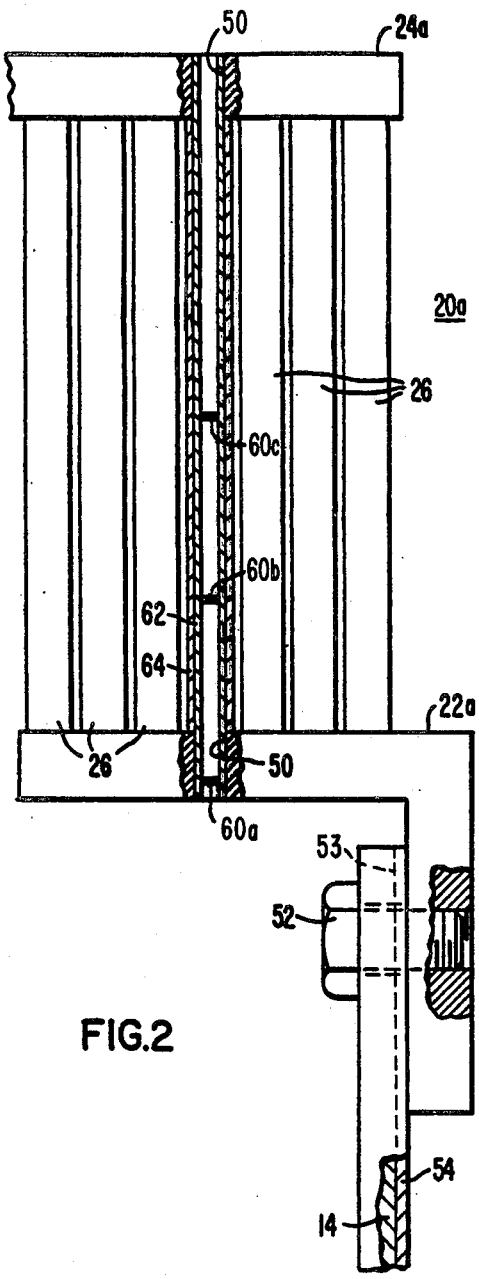
FIG. 2 shows a detailed view of the cryogenic lead of the present invention.

FIG. 2 shows a detailed view of the cryogenic lead 20*a* of the present invention. Both the upper 24*a* and lower 22*a* conductive blocks are provided with a plurality of holes 50 which are each shaped to receive one of the plurality of tubes 26. One end of each tube 26 is bonded to the upper conductive block 24*a* and the other end of each tube 26 is bonded to the lower conductive block 22*a*. In this way, the tubes 26 provide a plurality of parallel electrical paths which provide electrical communication between the lower 22*a* and upper 24*a* conductive blocks. A preselected terminus (for example, reference numeral 14 of FIG. 1) of the superconducting solenoid coil (reference numeral 12 of FIG. 1) is connected to the lower conductive block 22*a*, as shown in FIG. 2. The terminus 14 is brazed to the lower conductive block 22*a* to provide electrical communication therebetween. Also shown in FIG. 2 is a bolt 52 which provides an extra measure of mechanical rigidity between the terminus 14 and the lower conductive block 22*a*. The terminus 14 is shown in FIG. 2 as having a superconducting insert 54 disposed in a slot 53 formed in one surface of the terminus 14. It should be understood, however, that the specific configuration of the superconductive element 54, which can typically be made of a niobium-titanium alloy, and the conductive terminus 14, which can typically be made of copper, is only one of many alternative configurations.

In FIG. 2 one of the plurality of tubes 26 is shown in section view. This view illustrates the laminar sleeve construction of the tubes 26. An internal tubular sleeve 62, which is made of copper, is surrounded by an external tubular sleeve 64, which is made of stainless steel. The copper sleeve 62 is shown to be longer than the stainless steel sleeve 64 and extends beyond the stainless steel sleeve 64 at both ends of the tube 60. This extension of the copper sleeve 62 provides a means of metallurgically bonding the tube at each of its ends to the upper 24*a* and lower 22*a* conductive blocks. Within each tube is at least one fluid flow restrictor. In FIG. 2 three flow restrictors, 60*a*, 60*b* and 60*c*, are shown. The specific number of flow restrictors is a function of the particular design of the cryogenic lead which is being used, but it should be understood that an increased number of restrictors permits the orifice of each restrictor to be enlarged. This result can be beneficial in the design of the cryogenic lead 20*a* because it helps to prevent the orifice of the restrictors from being blocked during operation.

As described above, the presence of the restrictors, 60*a*, 60*b* and 60*c*, within tube 26 performs two functions. One function is to dominate the effects of viscosity of pressure drop along the length of the tube 26 and thus virtually eliminate thermal instability which can be caused by minor perturbations which affect the viscosity of the refrigerant flowing through the tube 26. Another function is to block the path of radiated thermal energy which otherwise would be able to pass freely down the length of the tube 26 in the direction from the upper conductive block 24*a* to the lower conductive block 22*a*. By restricting the cross-sectional area of the tube 26, the restrictors block the path of radiated thermal energy, which travels in a straight line. It should be apparent that when the each of the restrictors is positioned so that its orifice is aligned with the orifices of the other restrictors, a limited amount of thermal energy can pass, in a straight line path, through the aligned orifices. This minimal passage of radiated thermal energy can further be reduced by disposing the restrictors in the tube 26 in such a way that their orifices are misaligned, thus completely blocking the passage of the radiated thermal energy which is limited to straight-line travel.

Figure 3:
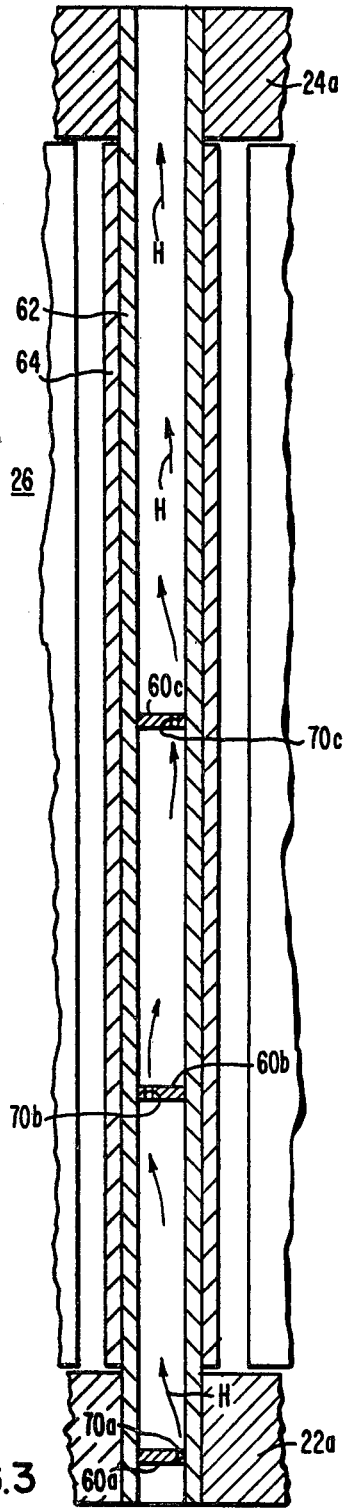
FIG. 3 illustrates the placement and effect of the orifices within a tube of the cryogenic lead of the present invention.

FIG. 3 illustrates a tube 26 of the present invention in greater detail. The tube 26 is shown metallurgically bonded to the upper conductive block 24*a* and lower conductive block 22*a* and consisting of an inner tubular sleeve 62 which is made of copper, or any other suitable material which is both thermally and electrically conductive, and surrounded by an outer tubular sleeve 64 which is made of stainless steel or any other material which is suitable to serve as a thermal mass which can absorb heat generated by the inner copper sleeve 62. Also shown in FIG. 3 is the extension of the copper sleeve 62 from both ends of the stainless steel sleeve 64 in the area where it is metallurgically bonded to the upper 24*a* and lower 22*a* conductive blocks. Inside the tube 26, three restrictors, 60*a*, 60*b* and 60*c*, are shown. Each restrictor is provided with an orifice, 70*a*, 70*b* and 70*c*, respectively. In FIG. 3 a plurality of arrows H are used to depict an exemplary path of gaseous refrigerant flow upward through the tube 26. It should be understood that the size of the orifices, 70*a*, 70*b* and 70*c*, the inside diameter of the tube 26 and the total number of tubes 26 used in combination to form a cryogenic lead are chosen in such a way as to not limit the overall flow of refrigerant through the cryogenic lead, but to allow the flow restrictors to dominate the effect of changes in viscosity on the pressure drop along the length of the tube 26. This domination reduces to insignificance the effect of the viscosity changes due on the overall pressure drop along the tube's length and thus effectively eliminates the potential thermal instability of the cryogenic lead which would normally result from the relationship of the pressure drop and the refrigerant's viscosity.

It should be understood that the lower conductive block 22*a* is typically at cryogenic temperatures of approximately −268° C. while the upper conductive block 24*a* is approximately at room temperature of approximately 27° C. The central region of the tube 26, where restrictor 60*c* is located, is at approximately −173° C. As the liquid refrigerant (reference numeral 18 in FIG. 1) boils, the gaseous refrigerant (reference numeral 32 in FIG. 1) travels upward through the tube 26 in the direction shown by arrows H. If the tube 26 had no restrictors placed within its bore, the pressure drop would directly be related both to the viscosity of the refrigerant and the length of the tube 26 and would inversely be related both to the velocity of the refrigerant traveling through the tube 26 and the square of the inside diameter of the inner sleeve 62 of the tube 26. Furthermore, if no restrictors were present in the bore of the tube 26, any increase in the flow rate of the refrigerant through a particular tube, relative to the flow through adjacent tubes, would cause an increased cooling of the tube with the higher flow rate. This increased cooling would lower the temperature of the tube with the increased refrigerant flow and, therefore, lower the viscosity of the refrigerant flowing therethrough. With a lower viscosity refrigerant flowing through the tube, that tube would experience a reduced pressure drop along its length. This reduced pressure drop along the length of the tube 26 would correspondingly lead to a higher flow rate through its central bore. This lower flow rate, in turn, would lead to a higher rate of cooling and hence a lowered temperature of the tube in question. This lowered temperature would lead to a lower viscosity and, therefore, a lower pressure drop within the tube which would further increase its flow and lead to a thermally unstable condition within the cryogenic lead in which the tube that experienced the initial perturbation would lead to ever-increasing refrigerant flows through it which would deprive its adjacent tubes of their proportional share of refrigerant flow.

It should be understood that when a particular tube's temperature is significantly lowered, its electrical resistance drops and, therefore, it tends to conduct a higher current than adjacent tubes operating at a higher temperature. This higher temperature, due to increased current flow through the tube, normally tends to raise the temperature of the tube and cause the opposite effect of the above-described thermal instability condition. However, it should be understood that the pressure drop, and also the reciprocal of the flow rate, are proportional to the temperature of the tube taken to the 1.65 power, whereas the local heat generated by the copper is inversely proportional to the temperature taken to the 1.4 power for temperatures above −173° C. Also, it should be understood that the pressure drop across all of the tubes 26 of the cryogenic lead is the same for each tube due to the fact that one end of each tube is in fluid communication with the gaseous reservoir of the containment (reference number 30 of FIG. 1) and the other end of each tube is in fluid communication with the same portion of the containment 30 that is proximate the liquid refrigerant 18. Since the pressure in the area of the lower conductive block 22*a* is generally identical for each tube 26 connected thereto, and the pressure proximate the upper conductive block 24*a* is generally the same for each tube end connected thereto, the total pressure drop through each of the tubes of the cryogenic lead must be generally identical. Furthermore, since one end of each tube is in electrical communication with the lower conductive block 22*a* and the other end of each tube is in electrical communication with the upper conductive block 24*a*, the resultant voltage potential across the cryogenic lead must be generally identical for each of the individual tubes 26 thereof.

The pressure drop instability exists because the pressure drop and, hence the reciprocal of flow rate for a constant pressure drop, of a conventional lead in laminar flow depends functionally on the temperature taken to the 1.65 power. Thus, a perturbation that reduces the flow of refrigerant through a tube produces a temperature rise which tends to further reduce the flow and therefore cause a rapid thermal escalation. The usual preventive measure to reduce this thermal instability requires the lead to be designed to have a very low pressure drop so that a perturbation in flow produces an increase in its heat leak at its cold end conductive block 22*a* and a larger increase in the pressure forcing the flow of refrigerant through the tube. Low pressure drop generally means poor heat transfer and a lead which is not operating near its optimum.

When electrical current and refrigerant flow is caused to be redistributed among the plurality of tubes of a cryogenic lead with an inadequate transverse thermal conductance, a temperature increase within the cryogenic lead can result. The flow redistribution and channel temperature rise occur because the local pressure drop and the reciprocal of flow rate are proportional to the temperature taken to the 1.65 power. A local downward perturbation in refrigerant flow causes a local rise in temperature which further reduces and redistributes the fluid flow. In a lead with low transverse conductance, redistribution of the electric current can also occur subject to the condition of the above-described equal voltage potential across each tube 26 of the cryogenic lead. The local heat generated in a tube, which is equal to its voltage squared and divided by its resistance, is inversely proportional to its temperature taken to the 1.4 power when the tube is above −173° C. Therefore, it should be apparent that, although a local variation in temperature influences only a part of the total resistance, the refrigerant flow resistance and electrical resistance are dominated by the part of the lead which is above −173° C. This causes a perturbation which reduces the flow locally within a tube to produce a temperature increase which is not completely offset by a reduction in heat generation. Overall thermal instability therefore results because the flow rate for a constant pressure drop along the length of a tube 26 is proportional to its temperature to the −1.65 power while the heat generation is proportional only to the temperature taken to the −1.4 power.

The cryogenic lead, made in accordance with the present invention, therefore preserves thermal stability within the lead by making the pressure drop along the length of each tube 26 independent of its temperature.

Referring again to FIG. 3, the addition of a stainless steel sleeve 64 around the copper sleeve 62 increases the heat capacity of the tube 26 and hence the length of time that the tube can operate as a heat sink if a momentary loss of coolant occurs. The stainless steel sleeve 64 also decreases the transverse thermal conductance which reduces the tube's ability to conduct heat away from relatively hot fluid channels. The flow in each tube 26 is made stable by providing a flow restrictor such as 60*a*, 60*b* or 60*c*, with an orifice, such as 70*a*, 70*b* or 70*c*, respectively. It should be understood that, although a tube made in accordance with the present invention could include a single flow restrictor, a more practical design would consist of two or more flow restrictors disposed within each tube in the area of the tube which is between the end of the tube which is at approximately −268° C. and the region of the tube which is at approximately −173° C. The use of a plurality of restrictors allows the orifice of each restrictor to be correspondingly enlarged compared to its required size when only one restrictor is used. This enlargement helps to reduce the chances of a blockage of the orifice and a resulting deleterious reduction of refrigerant flow through any particular tube.

As discussed above, the presence of restrictors within the tube 26 not only dominates over the effect of changes in viscosity on pressure drop within a tube, but also prevents heat from being radiated through the tube from the warm end, which is connected to the upper conductive block 24*a*, to the cold end, which is connected to the lower conductive block 22*a*. This blockage of thermal radiation can be further improved by arranging the restrictors, as illustrated in FIG. 3, with their orifices in a non-aligned pattern. Thus, by eliminating all straight-line radiation paths through the tube 26, the thermal radiation transmitted through the tube can virtually be eliminated.

It should be apparent that the present invention provides a cryogenic lead construction comprising a plurality of tubes which serve to prevent thermal instability resulting from a flow perturbation in any particular tube and also to reduce or eliminate radiated thermal energy which would otherwise be transmitted from the warm end of each particular tube to its cold end.

What I claim is:

1. An electrical lead, comprising:

a plurality of tubes, each of said plurality of tubes being a laminar assembly of an inner electrically conductive sleeve and an outer sleeve, said plurality of tubes being arranged in a parallel association;

an upper electrically conductive block connected to a first end of each of said plurality of tubes, said upper electrically conductive block having a plurality of holes therethrough, each of said plurality of holes being aligned in fluid communication with a preselected one of said plurality of tubes, said upper electrically conductive block being in electrical communication with said first end of each of said plurality of tubes;

a lower electrically conductive block connected to a second end of each of said plurality of tubes, said lower electrically conductive block having a plurality of holes therethrough, each of said plurality of holes of said lower electrically conductive block being aligned in fluid communication with a preselected one of said plurality of tubes, said lower electrically conductive block being in electrical communication with said second end of each of said plurality of tubes; and means for restricting fluid flow through the central bore of said inner electrically conductive sleeve, said restricting means having an orifice therein.

2. The lead of claim 1, wherein:

said inner electrically conductive sleeve is made of copper and said outer sleeve is made of stainless steel.

3. A tubular conductor, comprising:

a first tube, said first tube being electrically conductive;

a second tube disposed around said first tube in coaxial and concentric relation;

a first fluid flow restrictor disposed inside the central bore of said first tube, said restrictor having an orifice through which a fluid can pass;

means for conducting an electric current to a first end of said first tube;

means for conducting an electric current to a second end of said first tube; and means for directing a fluid through said first tube.

4. The conductor of claim 3, wherein:

said first tube is made of copper.

5. The conductor of claim 3, wherein:

said second tube is made of stainless steel.

6. The conductor of claim 3, wherein:

said first tube extends axially beyond said second tube at both ends of said second tube.

7. The conductor of claim 3, further comprising:

a second fluid flow restrictor disposed inside the central bore of said first tube, said second restrictor having an orifice through which a fluid can pass, said orifice of said second fluid flow restrictor being nonaligned with said orifice of said first fluid flow restrictor.

8. A fluid-cooled electrical lead, comprising:

a first electrical conductor;

a second electrical conductor; and a plurality of tubes, each of said plurality of tubes comprising;

(A) a tubular electrical conductor having a first end and a second end, said first end being in electrical communication with said first electrical conductor, said second end being in electrical communication with said second electrical conductor;

(B) a cylinder disposed around said tubular electrical conductor in coaxial and concentric relation, said cylinder being capable of conducting heat away from said tubular electrical conductor;

(C) means for directing a fluid refrigerant through the central bore of said tubular electrical conductor; and (D) a first means for restricting the flow of said fluid refrigerant through said tubular electrical conductor, said restricting means being disposed with the central bore of said tubular electrical conductor.

9. The fluid-cooled electrical lead of claim 8, wherein:

said restricting means is positioned to block thermal radiation from passing through said tubular electrical conductor.

10. The fluid-cooled electrical lead of claim 8, wherein:

said tubular electrical conductor is made of copper.

11. The fluid-cooled electrical lead of claim 8, wherein:

said cylinder is made of stainless steel.

* * * * *